United States Patent [19]

Jones

[11] 4,435,911

[45] Mar. 13, 1984

[54] INJECTION-MOLDED GAMING TOKEN AND PROCESS THEREFOR

[76] Inventor: Bernard B. Jones, 3672 S. Highland, Las Vegas, Nev. 89103

[21] Appl. No.: 371,638

[22] Filed: Apr. 26, 1982

Related U.S. Application Data

[63] Continuation of Ser. No. 15,334, Feb. 26, 1979, abandoned.

[51] Int. Cl.[3] ..... G09F 3/02

[52] U.S. Cl. ..... 40/27.5

[58] Field of Search ..... 40/27.5, 1.5, 1.6, 2 R, 40/2.2, 315, 330; 29/160.6, 453; 264/246; 273/148 R, 288, 290, 291; 428/64

[56] References Cited

U.S. PATENT DOCUMENTS

| | | | |
|---|---|---|---|
| 31,871 | 4/1861 | Copley | 40/27.5 |
| 1,715,238 | 5/1929 | Kleschka | 40/1.6 |
| 2,836,911 | 6/1958 | Priesmeyer | 40/27.5 |
| 3,953,932 | 5/1976 | Graves | 40/27.5 |
| 3,968,582 | 7/1976 | Jones | 40/27.5 |

*Primary Examiner*—Gene Mancene
*Assistant Examiner*—Michael J. Foycik, Jr.
*Attorney, Agent, or Firm*—John E. Benoit

[57] ABSTRACT

The specification describes an improved gaming token which includes, among other features, a relatively flat non-metallic annular ring having injection-molded indicia thereon bounded by sharp and durable color lines. This ring also includes an inner coin-support annulus which extends into a central opening of the ring and receives flat back-to-back metal slugs or discs on each surface thereof to retain these discs permanently in place once they are welded together. Since the outer coin surfaces are flush with the major surfaces of the flat non-metallic annular ring, this construction renders removal of the metal coins quite difficult.

In one embodiment of the invention, this coin-support annulus is integral with a single unitary plastic annular ring which includes regions of injection-molded indicia thereon which are flush with both major and minor surfaces of the ring and are bounded by the sharp and durable color lines as noted above.

4 Claims, 19 Drawing Figures

INJECTION-MOLDED GAMING TOKEN AND PROCESS THEREFOR

This is a continuation, of application Ser. No. 15,334 filed Feb. 26, 1979, and now abandoned.

FIELD OF THE INVENTION

This invention relates generally to denominational gaming tokens and more particularly to novel improvements in combination metal and plastic injection-molded gaming tokens. These tokens have specific utility as difficult-to-counterfeit casino chips of varying chosen monetary denominations.

BACKGROUND

In my U.S. Pat. No. 3,968,582, issued on July 13, 1976, I disclose and claim novel denominational gaming tokens (casino chips) and related injection-molding fabrication processes wherein these chips are constructed using total chip assembly techniques which makes these chips or tokens very difficult to counterfeit. At the same time, however, novel tokens are produced with sharp durable and permanent indicia color lines thereon which render these tokens readily distinguishable as to denomination, origin, etc. at normal game distances by players and gaming house personnel alike. Thus, not only did my above-identified invention overcome smear problems associated with loss of color definition in "paint-on indicia" type casino tokens, but it also eliminated the metal-to-cloth edge wear problems caused by metal inlay type casino chips. Additionally, this patented process makes token counterfeiting difficult by improving the total control which the final token assembler may exercise over the completed token.

THE INVENTION

The general purpose of this invention is to provide still further new and useful improvements in the above type of combination metal-and-plastic gaming tokens. These improvements to be described are manifested in an improved one-piece annular ring and metal coin retention construction which makes token disassembly difficult, simplifies token fabrication and also improves fabrication yields.

To achieve this purpose and realize these improvements, I have provided a gaming token which includes a relatively flat non-metallic annular ring having parallel major surfaces and concentric minor edge surfaces, with the inner edge surface defining a central opening of the ring. Injection-molded indicia regions are selectively spaced around and on the annular ring, flush with the major surfaces thereof, and are bounded by good, sharp and durable color lines. A coin-support annulus extends from the inner minor edge surface of the ring and into the central opening thereof by a predetermined distance. This coin-support annulus is integral with the non-metallic annular ring and is configured so as to receive on each side thereof back-to-back metal slugs or discs and permanently retain these metal slugs or discs in place on its opposing surfaces. When these discs are positioned on this coin-support annulus located in the central opening of the ring and flush with the major surfaces of the annular ring and then bonded or spot-welded together at their abutting surfaces, they become very difficult to remove by the average casino player or user of the token. Advantageously, this metal coin-support annulus may be made integral with a single unitary flat annular ring member which has been preconstructed to receive, in surface cavity regions and in a coplanar or flush fashion therewith, injection-molded indicia regions. These indicia regions may be formed during a single-step injection-molding operation.

Accordingly, it is an object of this invention to provide a new and improved combination metal and plastic gaming token which is difficult to disassemble and which is straightforward in its method of manufacture.

Another object of this invention is to provide a new and improved gaming token of the type described which may be constructed with one (rather than two) non-metallic annular rings and which possesses most, if not all, of the advantages of the invention described in my U.S. Pat. No. 3,968,582.

Another object is to provide these above-described mutually compatible novel features of the present invention which require less total fabrication piece parts and lower overall fabrication costs relative to my above-patented process.

A feature of this invention is the provision of a novel gaming token of the type described which includes a fluorescent or otherwise visually detectable dye directly incorporated into the injection-molded indicia regions of the token, thereby enabling the token to be readily identified as to its legitimacy or origin.

Another feature is the provision of a novel gaming token of the type described which includes a thin coil retention annulus for receiving abutting metal coins flush with the non-metallic annular ring of the token.

These and other objects and features of this invention will become more readily apparent in the following description of the preferred embodiments thereof, as illustrated in the accompanying drawings.

DRAWINGS

FIGS. 1*a* through 1*e* illustrate one annular ring member embodiment of the invention, using a single annular preform, whereas FIGS. 2*a* through 2*d* illustrates the matched preform pair annular ring construction according to the invention.

FIG. 1*a* is a perspective view of a completely assembled casino token embodying the invention.

FIG. 1*b* is an enlarged fragmented cross-sectional view taken along lines b—b of FIG. 1*a*.

FIG. 1*c* is a perspective view of the single annular preform member used in the construction of FIG. 1*a*.

FIG. 1*d* is a plan view of the non-metallic annular preform in FIG. 1*c*.

FIG. 1*e* is an enlarged cross-section view taken along lines e—e of FIG. 1*d*.

FIG. 2*a* is a perspective view of a completely assembled double preform casino token embodying the invention.

FIG. 2*b* is an enlarged fragmented cross-section view taken along lines b—b of FIG. 2*a*.

FIG. 2*c* is an exploded perspective view of the casino token of FIG. 2*a*.

FIG. 2*d* is an enlarged fragmented cross-section view taken along lines d—d of FIG. 2*c*.

FIGS. 3*a* through 3*h* illustrate, respectively, the process for assembling a single hexagonal metal coin in a flat non-metallic annular ring, using a novel convex-to-concave metal-to-non-metal edge surface contour which enables good permanent coin retention within the annular ring.

FIGS. 4a–4b illustrate further alternative embodiments of my invention exhibiting different, useful coin-retention configurations (geometries) for the metal coin or disc and the non-metallic annular ring, respectively.

DETAILED DESCRIPTION OF THE PREFERRED EMBODIMENTS

Figure 1A:
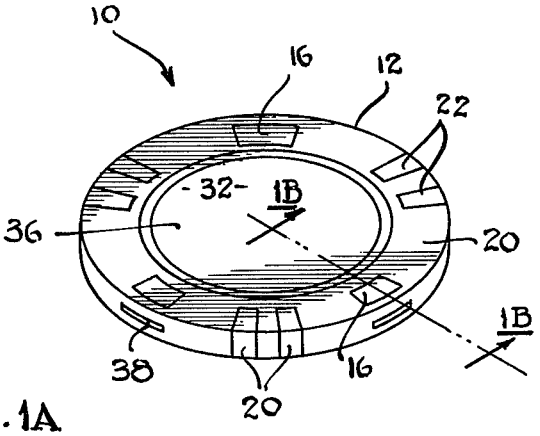
Figure 1B:
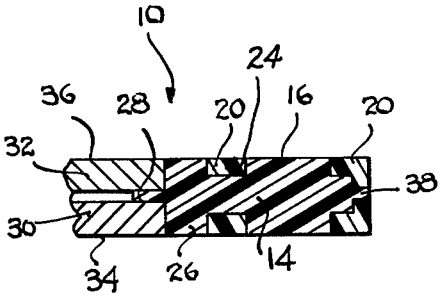
Figure 1C:
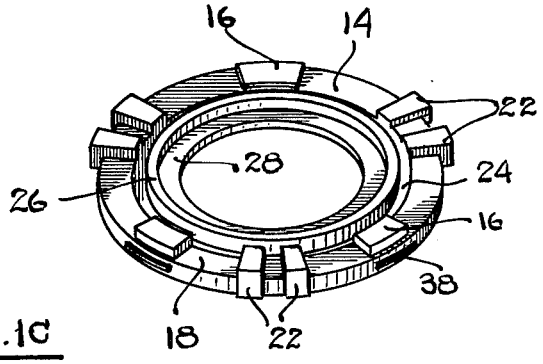
Figure 1E:
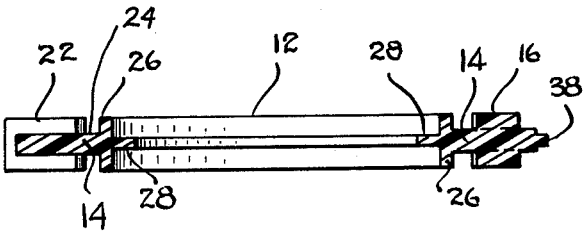
Figure 1D:
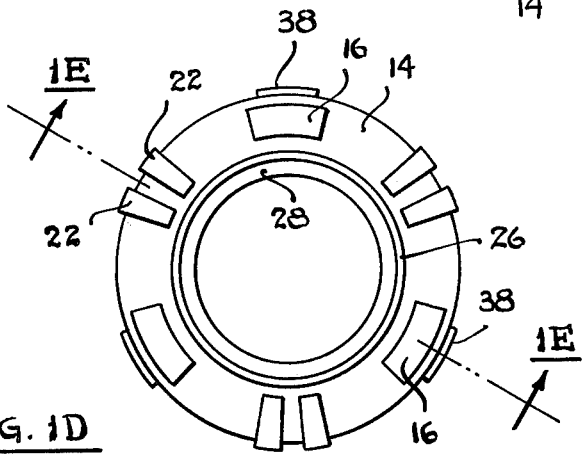

Referring now in sequence to FIGS. 1a through 1e, there is shown in FIG. 1a, in perspective view, a completed metal-and-plastic gaming token which is designated generally at 10 and which includes a flat annular non-metallic ring member 12. The unitary annular ring member 12 includes therein a plastic preform and molding material to be further described and is constructed by initially providing a single non-metallic annular ring preform 14, configured as indicated in FIG. 1b and FIG. 1c. This plastic preform 14 in FIG. 1c can be stamped out or injection-molded in any desired configuration using well-known injection-molding techniques, and preferably will include symmetrically spaced indicia patterns around the annulus of the preform. These patterns are defined in FIGS. 1a through 1e in part by a plurality of upstanding vertical members or posts 16 which are integral with and extend perpendicular to a thin flat annular rib member 14. The thick vertical posts 16 and the thinner annular rib 14 integral therewith are adapted to receive, in a coplanar fashion to be described, an injection-molding compound 20 (as shown in FIG. 1b) which differs in color from that of the preform. In this manner, the preform 14 and molding compound 20 define selectively spaced color patterns which may be used to indicate either the origin, ownership or denomination of the token. In addition, these color patterns may be configured to further include integral upstanding letters or numbers (not shown) which are spaced along the portions of the rib 18 between the vertical posts 16. Such patterns may, for example, include lettering such as "MGM" or "HARVEYS" which have a vertical extent equal to that of the vertical posts 16. Thus, a hot liquid molding compound 20 of a color different from that of the annular preform 14 may be injected around all of the vertical posts 16 and additional chosen identifying lettering (not shown) therebetween. This may be accomplished using, for example, the injection-molding process and apparatus disclosed in may above-identified U.S. Pat. No. 3,968,582.

Referring now in more detail to the particular annular geometry of the non-metallic preform shown in FIGS. 1b through 1e, the vertical posts 16 which form part of one major outer surface area are alternately spaced between smaller closely spaced vertical post pairs 22, each having a trapezoidal shaped upper surface area. These upper surface areas of the vertical posts 16 and 22 ultimately become coplanar with the surrounding injection-molding compound 20 (FIG. 1b) which also flows into the cylindrical mast or trough 24 and is there retained by a cylindrical upstanding wall 26. The upper surface of the cylindrical upstanding wall 26 is also coplanar with the molding compound 20 and with the previously identified trapezoidal shaped surfaces of the upstanding vertical posts 16 and 22. The flat annular rib 14, the vertical posts 16 and 22, and the cylindrical molding compound retaining wall 26 are all integral, one with another, and are formed, as mentioned, as a single annular unitary non-metallic preform member.

An inner non-metallic coin retention annulus 28 is also an integral part of this preform and is located, as shown, at the midpoint of the inner annular surface of the cylindrical upstanding retaining wall 26. This coin retention annulus 28 is adapted to receive abutting metallic discs or coins on its opposing upper and lower major surfaces. The coin retention annulus 28 is relatively thin so that coins can be mounted on the opposing surfaces thereof and then spot-welded together at or near the center of the annulus 28. Thus, as shown in FIG. 1b, the two metal coins 30 and 32 have their outer indicia surfaces 34 and 36 coplanar with the outermost major surfaces of the injected-molded preform 14 and are thereby difficult to remove by hand after being welded or bonded together, as described.

The non-metallic preform 14 described above also includes a plurality of radially extending tabs 38 which are positioned as shown at the outer periphery of the preform and are ultimately made radially coextensive with the injection-molding compound 30. Thus, during an injection-molding operation, these radial tabs will abut the cylindrical walls of an injection-molding apparatus (not shown) and interrupt the flow of the injection-molding compound when the compound is compressed around the preform and its previously identified parts.

Figure 2A:
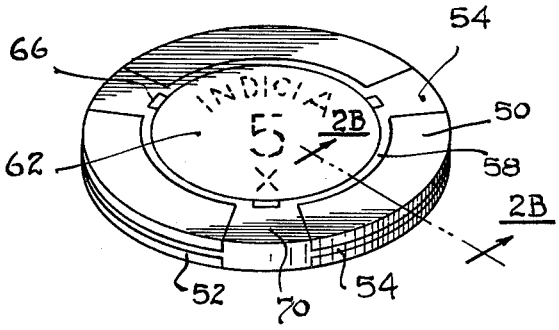
Figure 2B:
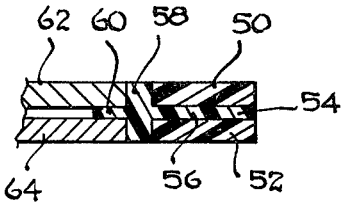
Figure 2C:
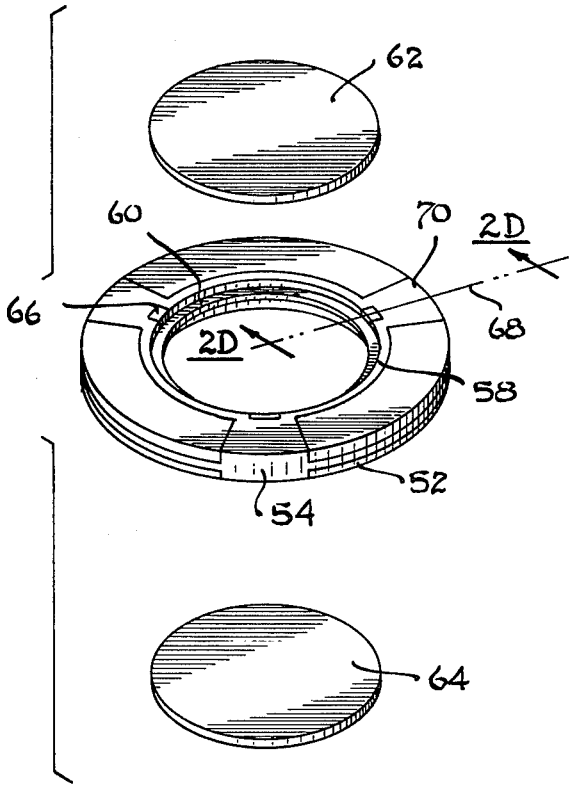

Referring now to FIGS. 2a through 2b, the assembled token in FIG. 2a includes a pair of matched and aligned plastic preform members 50 and 52 generally of the type described in my above U.S. Pat. No. 3,968,582. These plastic preforms 50 and 52 are configured to receive injection molding 54 which flows in and around the offset regions thereof, and in this embodiment of my invention, the molding compound, upon cooling, sets to form and define a radial rib member 56, an inner annular rim member 58, and a coin retention annulus 60 which are all integral, one with another. The coin-support annulus 60 receives a pair of metal coins 62 and 64, as indicated in FIGS. 2b and 2c. This construction thus enables the outer surfaces of the metal coins 62 and 64 to be flush and coplanar with the outer upper surfaces of the non-metallic annular ring which surrounds it and formed by the previously identified preform and molding compound members 50, 52 and 58, as shown in FIG. 2b.

Figure 2D:
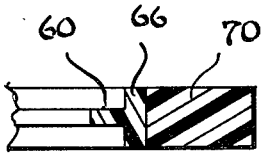

Referring to FIGS. 2c and 2d, the two matched preforms each have rectangular markers 66 located at the 120 degree positions of the token and on the center lines 68 of the three injection-molding indicia regions 70. The size and spacing and color of these regions 70 may, of course, be varied to indicate a particular token denomination or other characteristic of the token, and these regions 70 will preferably contain a fluorescent dye or the like which readily distinguishes the token and enables it to be identified as to its legitimacy.

The gaming tokens shown in both of the above embodiments of the invention may be finally assembled by one source, e.g., the inventor or his assignee, under strict security control, rather than a vendor source, and this feature minimizes the risk of token theft. Additionally, during final token assembly metallic coins of these tokens may be multi-colored by the selective application of paint or etchant, and alternatively of self-adhesive label or cover may be applied over the metallic coins in lieu of an embossment, painted or etched feature.

The diameter and thickness of the gaming tokens described above can be readily changed to suit specific requirements, and the particular method of injection-molding used in token fabrication easily lends itself to making such changes in token size. Thus, where a long series of initials or a relatively large logo (or both) are to be used in the preform or preforms between the vertical posts thereof, an increase in preform diameter, width and major surface area will accommodate such an added space requirement.

Figure 3A:
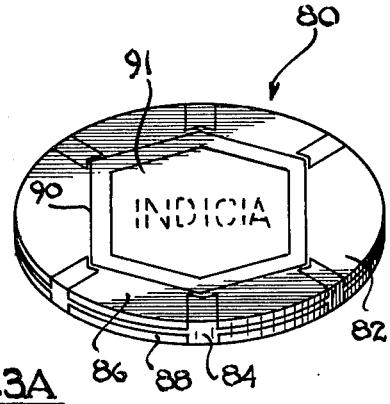

Referring now in sequence to FIGS. 3*a* through 3*h*, there is shown in FIG. 3*a* a combination plastic-metal gaming token 80 including an outer flat non-metallic (plastic) annular ring 82 which may be constructed using injection-molding processes described in my U.S. Pat. No. 3,968,582 and may be of either the one-preform or two-preform construction. Using the one-preform construction, the central portion 84 of the ring is the plastic preform, and the upper and lower portions 86 and 88 of the ring are formed by injecting a molding compound around this preform 84 in the manner generally taught in my U.S. Pat. No. 3,968,582.

The injection molds (not shown) are configured to produce an inner hexagonal-shaped edge surface which is generally designated 90 in FIG. 3*a*, and a hexagonal shaped metal coin 91 is press-fitted into the central opening of the non-metallic annular ring 82 in a manner to be described. However, the contour of the coin edge is not limited to six sides and may include other polygons which are compatible with coin retention specifications and economical manufacturing techniques.

Figure 3B:
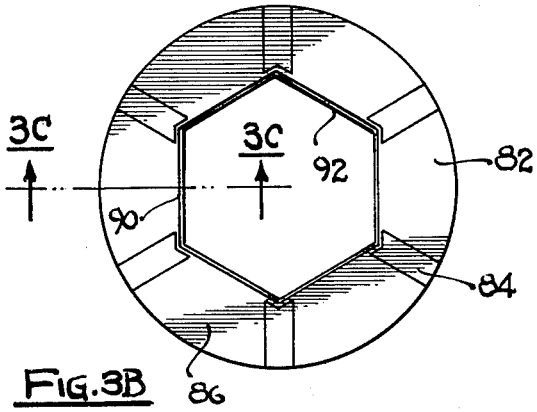
Figure 3C:
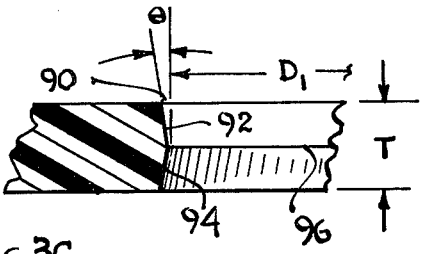

Referring now to FIGS. 3*b* and 3*c*, the inner hexagonal edge of the non-metallic annular ring in FIG. 3*b* has a downwardly extending surface segment 92 which meets with the upwardly extending surface segment 94 at a central horizontal plane which extends through the vertical center of the opening in the annular ring 82. Both of these inner edge surface segments 92 and 94 are molded to an approximate 10 degree angle $\theta$ with respect to vertical and thereby define a convex inner edge surface which is a mirror image of the concave outer edge surface of the hexagonal-shaped metal coin or disc 91 once the disc 91 is press-fit into the annular ring 82.

Figure 3D:
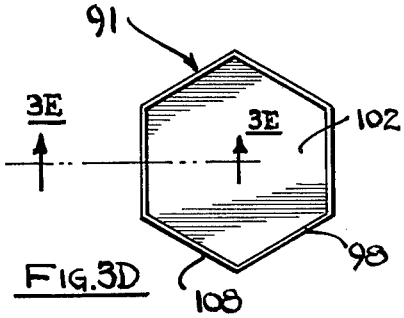
Figure 3E:
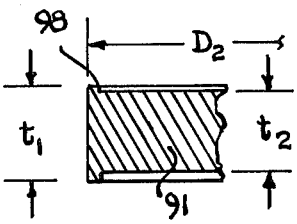

Referring now to FIGS. 3*d* and 3*e*, the metal coin 91 has an upstanding outer rim or edge 98 with a thickness which is slightly greater than the thickness of the annular ring 82. This novel metal coin construction is particularly advantageous for two reasons, as will be illustrated in FIG. 3*f*. Firstly, the upstanding rim 98 is adapted to receive a work piece 100 in a press-fit downward motion of member 100 and prevent any surface-to-surface contact between the major surface area 102 of the metal coin 91 and the contact surface area 104 of the press-fit work piece 100. This feature is desirable from the standpoint of minimizing scratching and abrasing of the metal coin 91 during its press-fit with the non-metallic annular ring 82. Secondly, during the above press-fit operation, as illustrated in FIG. 3*f*, the press-fit contact outer edge surfaces 106 and 108 of the metal coin 91 are enabled to be deformed radially inward with some ease as a result of the particular geometry of the rim 98 of the coin 91 as force is exerted, as indicated at the arrows 110 and 112.

Figure 3F:
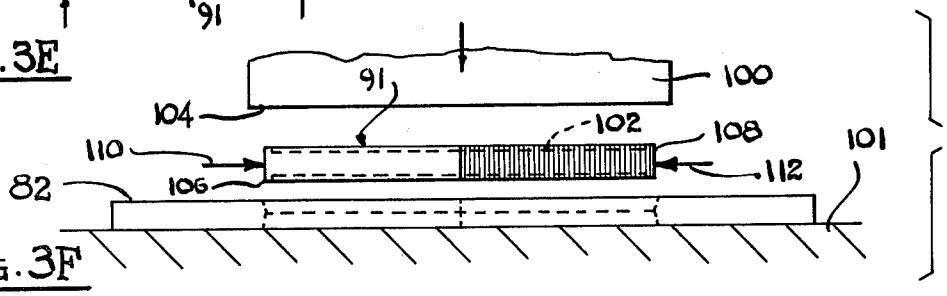
Figure 3G:
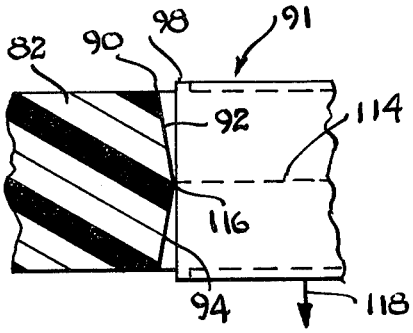
Figure 3H:
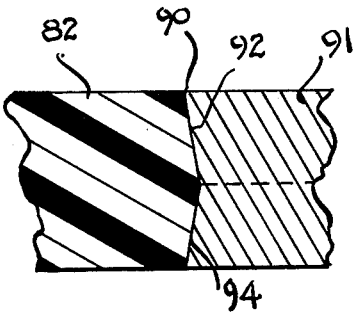

The above metal-coin-deformation process is illustrated in more detail in FIGS. 3*g* and 3*h* wherein, in the initial downward stroke of the work piece 100, the coin 91 is moved from the relative position of FIG. 3*f* to the position shown in FIG. 3*g*. Although the metal coin 91 never comes to a "rest" position, as illustrated in FIG. 3*g*, in large scale production of these gaming tokens, the coin 91 does pass through the coin-to-annular ring relative vertical position shown in FIG. 3*g* where the horizontal center line 114 of the coin 91 is precisely registered with the vertex 116 of the annular ring 82, thereby enhancing token symmetry once the metal-to-plastic press-fit operation is completed.

Once the continuing downward thrust of the work piece 100 presses the coin 91 in a downward motion indicated by the arrow 118, the abutting metal and plastic outer and inner edge surfaces of the coin and ring, respectively, as shown in FIG. 3*g*, begin to "mate" or conform, as shown in FIG. 3*h*. Thus, the particular rim geometry of the metal coin 91 and the ability of the coin 91 to be deformed radially inward enables the metal coin 91 to transform the vertical press-fit motion of the work piece 100 into a lateral or horizontal deformation movement and thereby cause the completed press-fit geometry of the ring and token to assume the conforming and surface-abutting geometry, as illustrated in FIG. 3*d*. However, the shapes of the work pieces 100 and 101 in FIG. 3*f* are only exemplary in nature and may include other configurations, such as for example, two identical solid polyhedrons with cross-sections identical to that of the coin being stamped into place. Thus, by mere inspection of the completed convex-concave conforming surface geometry of the metal coin-plastic annular ring structure of FIG. 3*h*, it will be appreciated that the metal coin 91 will be extremely difficult to pry away and remove from its surrounding and retaining annulus.

Figure 4A:
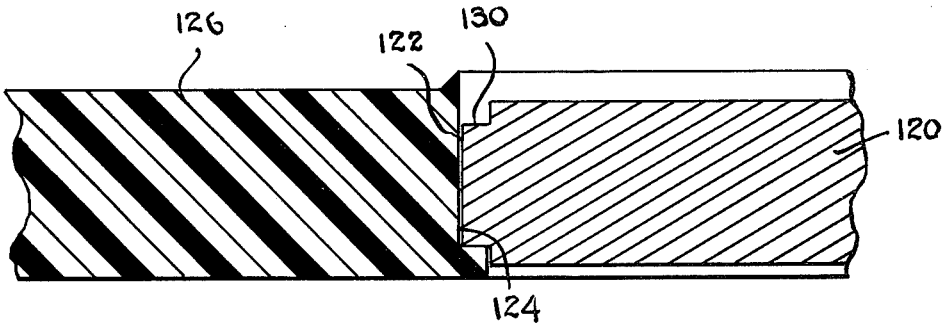
Figure 4B:
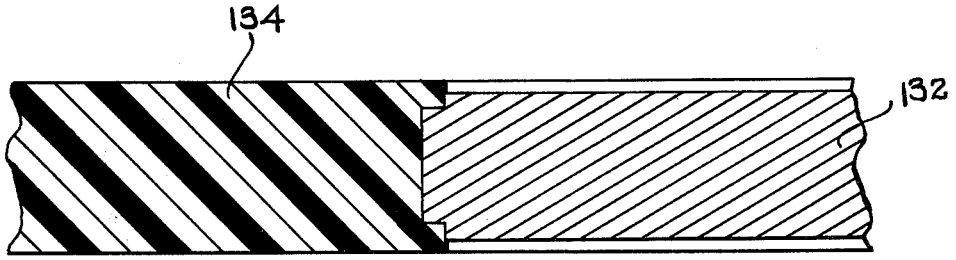

Referring now to FIGS. 4*a* and 4*b*, there are shown two alternative embodiments of coin retention within the scope of my invention. In FIG. 4*a*, the metal coin 120 is machined so as to leave an outer rim or shoulder 122 which is contoured as shown to fit into the recessed area 124 of the adjoining annular ring 126. The ring 126 has an upper tab or flap 128 which is deformable and, during token assembly, is bent clockwise 90 degrees so as to conform to the upper surface 130 of the coin's rim 122. This metal-to-plastic fitting step may be accomplished, for example, by initially ultrasonically softening the upstanding flap 128 and then either ultrasonically bonding the plastic flap 128 to the metal or, alternatively, using thermocompression bonding techniques to press the respective metal and plastic edges of the members 120 and 126 in uniform and symmetrical edge-abutting relationship. Thus, after assembly, the structure in FIG. 4*a* will closely resemble the structure in FIG. 4*b*.

Referring now to FIG. 4*b*, there is illustrated the "mold-around-the-coin" approach to token construction wherein the metal coin 132 is initially laid in place in an injection-molding apparatus (not shown), but generally of the same type of injection-molding apparatus that is shown and described in my above U.S. Pat. No. 3,968,582. Then, a hot molding compound is injected under pressure in a predefined volume of space surrounding the coin 132 to thereby form the non-metallic annular ring 134, with the C-shaped outer edge geometry which conforms to the mesa edge construction of the metal coin 132.

Although the invention described above makes frequent reference to sharp and durable color lines which are achievable in the non-metallic annular ring of the token, it is obviously within the scope of this invention to use preform and a molding compound of the same color if a non-metallic ring of one color is desired for any particular reason. Various other modifications may be made in the above-described embodiments without departing from the true scope of this invention. For example, the invention is in no way limited to a circular and cylindrical token configuration as shown in the drawings, but may instead utilize rectangular, triangular, elliptical, square, or various other odd-shaped configurations within the scope of the appended claims.

It is also within the scope of this invention to vary the size and geometrical configurations of the upstanding protrusions on the non-metallic preforms of the annular ring as well as to vary the colors of both of these protrusions and the color of the injection molding surrounding these protrusions. Additionally, the present invention is not limited to the spot-welding of the metal coins in the center of the non-metallic annular ring, and will include any bonding process such as ultrasonic or thermo-compression bonding, which is suitable for securing these metal coins one to another by fusion. Furthermore, these metal coins may assume any geometry other than the circular and hexagonal shapes of the preferred embodiments and may be secured in place in the center of the non-metallic annular ring in any arrangement where the outer major surfaces of these metal coins are substantially flush with the adjacent major surfaces of the annular ring. Obviously, the word "flush" is intended to include metal-to-non metal adjacent surface offsets of several mils or more, and such offsets may be necessary for, or a result of, the stamping process used for bonding or welding these coins together, or bonding a single coin into, the central annulus of the non-metallic annular ring.

I claim:

1. A gaming token comprising:

(a) a flat non-metallic annular ring having a central opening therein, said ring comprising:
an annular rib member; and
a plurality of selectively spaced color regions therein sharply defined in geometry by a molding compound of a selected color, in intimate contact with said annular rib member, (b) a disc-support annulus integral with said annular ring and extending radially into said central opening to a predetermined radial distance, (c) flat metal discs mounted face-to-face on each side of said disc-support annulus and positioned substantially flush respectively with the outer surfaces of said annular ring, and (d) a fused junction for joining said metal discs together at a portion of their adjacent faces, whereby said metal discs are difficult to remove from said gaming token.

2. A gaming token comprising:

(a) a single unitary relatively flat annular ring having a central opening comprising:
(b) an annular ring member;
(c) upstanding spaced apart members integral with and normal to said annular rib member and forming a unitary part of said annular ring member,
(d) a molding compound differing in color from upstanding members and disposed around said upstanding members and flush with outer surfaces thereof to form smooth flat surfaces for said annular ring,
(d) a coin retention annulus extending from said annular ring radially into said central opening of said annular ring,
(e) a pair of metal coins in face-to-face relationship on opposite surfaces of said coin retention annulus with each coin substantially flush with one of said flat surfaces of said annular ring, and
(f) a fused section for joining said metal coins together at a portion of their adjacent faces.

3. The token defined in claim 2 wherein:

(a) said upstanding members include a single vertical cylindrical wall from which said coin support annulus extends radially inward into said central opening and from which an outer radial rib member extends toward the outer edge of said token, and (b) said molding compound surrounds said outer radial member and forms, with said wall, the smooth opposing major surfaces of said token.

4. A process for fabricating a combination metal-and-plastic casino token which comprises the steps of:

(a) providing a single plastic annular ring having a central opening therein;

(b) providing a coin support annulus integral with said annular ring and extending radially into said central opening a predetermined distance (c) placing metal coins in said central opening of said annular ring in face-to-face relationship on opposite sides of said annulus and substantially flush respectively with the outer surfaces of said ring, and (d) fusing said metal coins together at a portion of their adjacent faces.

* * * * *